US008851311B2

(12) United States Patent
Castillo Higareda et al.

(10) Patent No.: US 8,851,311 B2
(45) Date of Patent: Oct. 7, 2014

(54) BOTTLE WITH TOP LOADING RESISTANCE

(75) Inventors: Jose de Jesus Castillo Higareda, Racine, WI (US); Peter M Neumann, Racine, WI (US); Holger Hampf, Ventura, CA (US); Matthew D. Hern, Malibu, CA (US); Gary B. Swetish, Racine, WI (US); Benjamin R. Lloyd, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 408 days.

(21) Appl. No.: 12/961,042

(22) Filed: Dec. 6, 2010

(65) Prior Publication Data

US 2012/0138564 A1 Jun. 7, 2012

(51) Int. Cl.

| | |
|---|---|
| ***B65D 23/00*** | (2006.01) |
| ***B05B 11/00*** | (2006.01) |
| ***B65D 23/10*** | (2006.01) |

(52) U.S. Cl.

CPC ..... *B05B 11/0037* (2013.01); *B65D 23/00* (2013.01); *B65D 23/102* (2013.01); *B05B 11/3011* (2013.01); *B05B 11/303* (2013.01)

USPC ..... 215/379; 215/384

(58) Field of Classification Search

CPC ..... B65D 23/00; B65D 23/102

USPC ..... 215/379, 384

See application file for complete search history.

(56) References Cited

U.S. PATENT DOCUMENTS

| | | | | | |
|---|---|---|---|---|---|
| 3,152,710 | A | * | 10/1964 | Platte | 215/384 |
| 4,877,142 | A | * | 10/1989 | Doering | 215/382 |
| 4,949,861 | A | * | 8/1990 | Cochran | 215/42 |
| 5,217,128 | A | | 6/1993 | Stenger | |
| 5,407,086 | A | | 4/1995 | Ota et al. | |
| 5,735,420 | A | | 4/1998 | Nakamaki et al. | |
| 5,908,127 | A | | 6/1999 | Weick et al. | |
| 5,918,753 | A | * | 7/1999 | Ogg et al. | 215/382 |
| D414,700 | S | | 10/1999 | Zogg | |
| 5,971,215 | A | * | 10/1999 | Bartsch | 222/153.13 |
| 6,070,753 | A | * | 6/2000 | Hirst et al. | 220/674 |
| 6,095,360 | A | | 8/2000 | Shmagin et al. | |
| 6,161,713 | A | | 12/2000 | Krich | |
| 6,164,474 | A | | 12/2000 | Cheng et al. | |
| 6,247,606 | B1 | | 6/2001 | Zogg | |
| 6,349,838 | B1 | | 2/2002 | Saito et al. | |
| 6,398,052 | B1 | | 6/2002 | Cheng et al. | |
| 6,431,401 | B1 | | 8/2002 | Giblin et al. | |
| 6,464,106 | B1 | | 10/2002 | Giblin et al. | |
| 6,555,046 | B1 | * | 4/2003 | Koda et al. | 264/520 |
| 6,585,123 | B1 | | 7/2003 | Pedmo et al. | |
| 6,662,960 | B2 | | 12/2003 | Hong et al. | |

(Continued)

FOREIGN PATENT DOCUMENTS

| | | | |
|---|---|---|---|
| EP | 0 751 071 | B1 | 11/2001 |
| WO | WO 2004/028910 | A1 | 4/2004 |
| WO | WO 2005/123517 | A1 | 12/2005 |

*Primary Examiner* — Sue A Weaver

(57) ABSTRACT

Bottles with improved top loading resistance are disclosed herein. The bottles may have generally "square" body profiles and may include structural features such as variable wall thickness, specific shoulder angles, and other structural reinforcement components. The bottle may have one or both of the following characteristics: a weight and barrel thickness specific top loading strength of no less than 2.30 lbf/g×mm and a weight and volume specific top loading strength of no less than 1.00 lbf×L/g.

19 Claims, 13 Drawing Sheets

(56) References Cited

U.S. PATENT DOCUMENTS

| | | | | |
|---|---|---|---|---|
| 6,695,162 | B1 | 2/2004 | Boukobza et al. | |
| 6,763,969 | B1 | 7/2004 | Melrose et al. | |
| 6,923,334 | B2 | 8/2005 | Melrose et al. | |
| 6,964,347 | B2 | 11/2005 | Miura | |
| 6,998,091 | B2 * | 2/2006 | Iizuka et al. | 264/516 |
| 7,051,890 | B2 | 5/2006 | Onoda et al. | |
| 7,108,146 | B2 | 9/2006 | Itokawa et al. | |
| 7,169,418 | B2 * | 1/2007 | Dalton et al. | 426/110 |
| 7,228,981 | B2 | 6/2007 | Chisholm | |
| 7,481,326 | B2 | 1/2009 | Itokawa et al. | |
| 7,712,624 | B2 * | 5/2010 | Scarola et al. | 220/675 |
| 2001/0037992 | A1 | 11/2001 | Tanabe et al. | |
| 2002/0084283 | A1 | 7/2002 | Giblin et al. | |
| 2004/0251258 | A1 * | 12/2004 | Akiyama et al. | 220/475 |
| 2006/0138074 | A1 | 6/2006 | Melrose | |
| 2006/0191860 | A1 | 8/2006 | Eisenbarth | |
| 2006/0255005 | A1 | 11/2006 | Melrose et al. | |
| 2007/0068894 | A1 | 3/2007 | Iwashita et al. | |
| 2007/0114200 | A1 | 5/2007 | Lane | |
| 2007/0199915 | A1 | 8/2007 | Denner et al. | |
| 2008/0047964 | A1 | 2/2008 | Denner et al. | |
| 2008/0149588 | A1 | 6/2008 | Nemoto et al. | |
| 2009/0065468 | A1 | 3/2009 | Hata et al. | |
| 2009/0266782 | A1 | 10/2009 | Lane | |
| 2010/0012617 | A1 | 1/2010 | Ulibarri et al. | |
| 2010/0080944 | A1 * | 4/2010 | Etesse | 428/36.92 |

* cited by examiner

BOTTLE WITH TOP LOADING RESISTANCE

BACKGROUND

1. Technical Field

This disclosure generally relates to bottles and more particularly to bottles with improved top loading resistance.

2. Description of the Related Art

Liquid, flowable and/or sprayable consumer products have been marketed in plastic bottles, such as those made of polyolefins or polyesters. Exemplary bottle materials include polypropylene (PP) and polyethylene terephthalate (PET). While conventionally packaged in non-transparent containers with relatively thick sidewalls, larger quantities (e.g. 500-2000 mL) of heavier products, such as cleaning or detergent liquids, are now capable of being packaged in durable and recyclable plastic bottles with transparent and relatively thinner sidewalls.

Those bottles filled with liquid products often need to be vertically stacked on top of one another, such as during transportation, warehouse storage and/or at point-of-purchase display. The top loading resistance of the bottles required for stacking may depend upon the type of products and the specific stacking configurations. However, conventional plastic bottles generally have limited and insufficient top loading resistance, especially when the products are heavier liquids. As a result, bottles filled with liquid products located at the bottom of a stack may be subjected to substantial top loading forces and may buckle or even collapse, causing economic loss in terms of inventory replacement and the labor needed for clean-up, or damage to the facility or vehicle in which the collapse occurs.

Accordingly, efforts have been directed to increasing the top loading resistance of plastic bottles. For example, bottles with a smoothly curved continuous body wall have been found to have good top loading strength. When the body of the bottle includes interconnected walls, it is generally considered desirable to make the transition edge between the walls gradual or "rounded" in order to improve the top load strength of the bottle. Thus, bottles with curved and rounded body profiles are generally considered as having better top loading strength than bottles having more abrupt transitions that may be considered to form relatively "square" profiles.

Bottles with variable wall thickness are also known in the art. For example, it has been found that gradual thickening of the sidewall (up to four times), both upwardly toward the shoulder and neck portions and downwardly toward the bottom base portion, improves bottle strength against laterally imposed stacking and crushing loads, such as in a vending machine. However, the effectiveness of such a wall thickness profile against top loading forces is not known. Moreover, while thickness variation along the longitudinal axis of a bottle may affect the bottle's top loading strength, the effect of latitudinal thickness variation in the bottle remains to be seen.

Finally, bottles constructed with thicker walls and/or more commodity material are generally expected to have greater top loading resistance than bottles with thinner walls and/or less plastic material. Thus, it would be economically and environmentally desirable and unexpected to maintain or even improve the top loading resistance of a bottle while reducing the amount of commodity material used to manufacture it.

SUMMARY OF THE DISCLOSURE

Bottles with improved top loading resistance are disclosed herein. The bottles may have generally "square" body profiles and may include structural features such as variable wall thickness, specific shoulder angles, and other structural reinforcement components.

In one exemplary embodiment, the bottle may include a neck terminating in a mouth and a barrel connected to a base. The bottle may have a weight and barrel thickness specific top loading strength of no less than 2.30 lbf/(g×mm).

In another exemplary embodiment, the bottle may include a neck terminating in a mouth and a barrel connected to a base. The bottle may have a weight and volume specific top loading strength of no less than 1.00 (lbf×L)/g.

In yet another exemplary embodiment, the bottle may include a neck terminating in a mouth and a barrel connected to a base. The bottle may have a weight and volume specific top loading strength of no less than 1.00 (lbf×L)/g and a weight and barrel thickness specific top loading strength of no less than 2.30 lbf/(g×mm).

As used in this disclosure, "thickness" of a structural component of a bottle refers to wall thickness unless otherwise indicated. If wall thickness of the structural component is not uniform, "thickness" used in this disclosure refers to the average wall thickness of the structural component unless otherwise indicated.

Other features of the disclosed bottle will be described in greater detail below. It will also be noted here and elsewhere that the bottle disclosed herein may be suitably modified to be used in a wide variety of applications by one of ordinary skill in the art without undue experimentation.

BRIEF DESCRIPTION OF THE DRAWINGS

For a more complete understanding of the disclosed bottle, reference should be made to the exemplary embodiments illustrated in greater detail in the accompanying drawings, wherein.

It should be understood that the drawings are not necessarily to scale and that the disclosed exemplary embodiments are sometimes illustrated diagrammatically and in partial views. In certain instances, details which are not necessary for an understanding of the disclosed bottle which render other details difficult to perceive may have been omitted. It should be understood, of course, that this disclosure is not limited to the particular exemplary embodiments illustrated herein.

DETAILED DESCRIPTION OF THE DISCLOSURE

As indicated above, this disclosure is generally directed toward bottles and more particularly related to improvement of top loading resistance of such bottles. As will be explained in further detail herein, it does so by, among other things, incorporating walls of particular dimensions and tapers, providing shoulder and other transition zones at particular angles, and/or utilizing other structural features. Surprisingly, the disclosed bottles with relatively square body profiles achieve better top loading strength than known bottles with relatively rounded body profiles, an unexpected result heretofore unknown. It is to be understood that the disclosed bottles may be transparent, translucent, opaque, or non-transparent and may be colored or colorless.

Moreover, the bottle disclosed herein may be made of thermoplastic materials such as polyolefins or polyesters. For example, the bottle may be made of polyethylene, polypropylene, polyethylene terephthalate, or the like. However, other polymeric materials, inorganic materials, metallic materials, or composites or laminates thereof may also be used. Further, the materials used in the disclosed bottles may be natural or synthetic.

Figure 1:
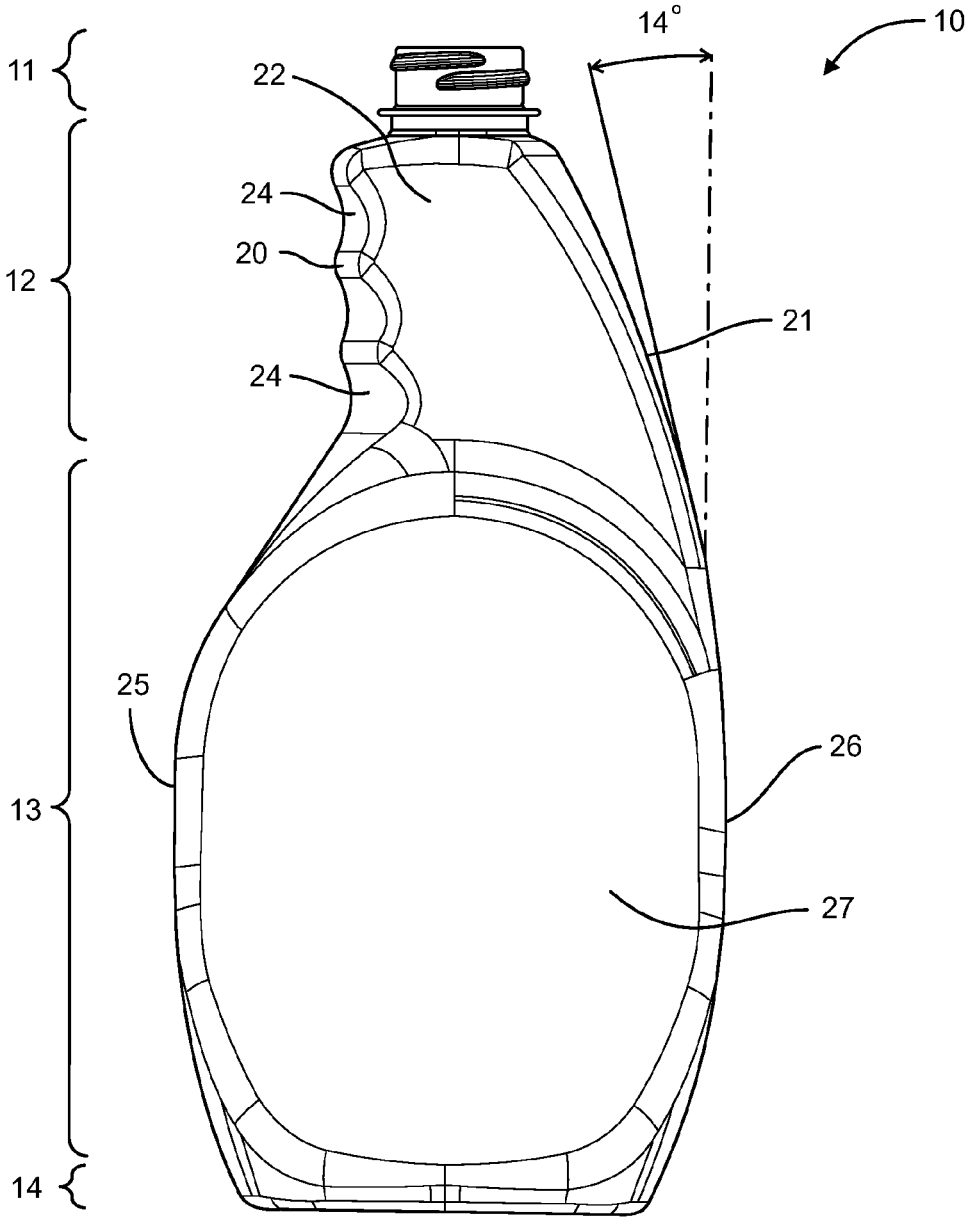
FIG. 1 PRIOR ART
FIG. 1 is a side view of a known bottle (prior art) with a relatively rounded body profile.
Figure 2:
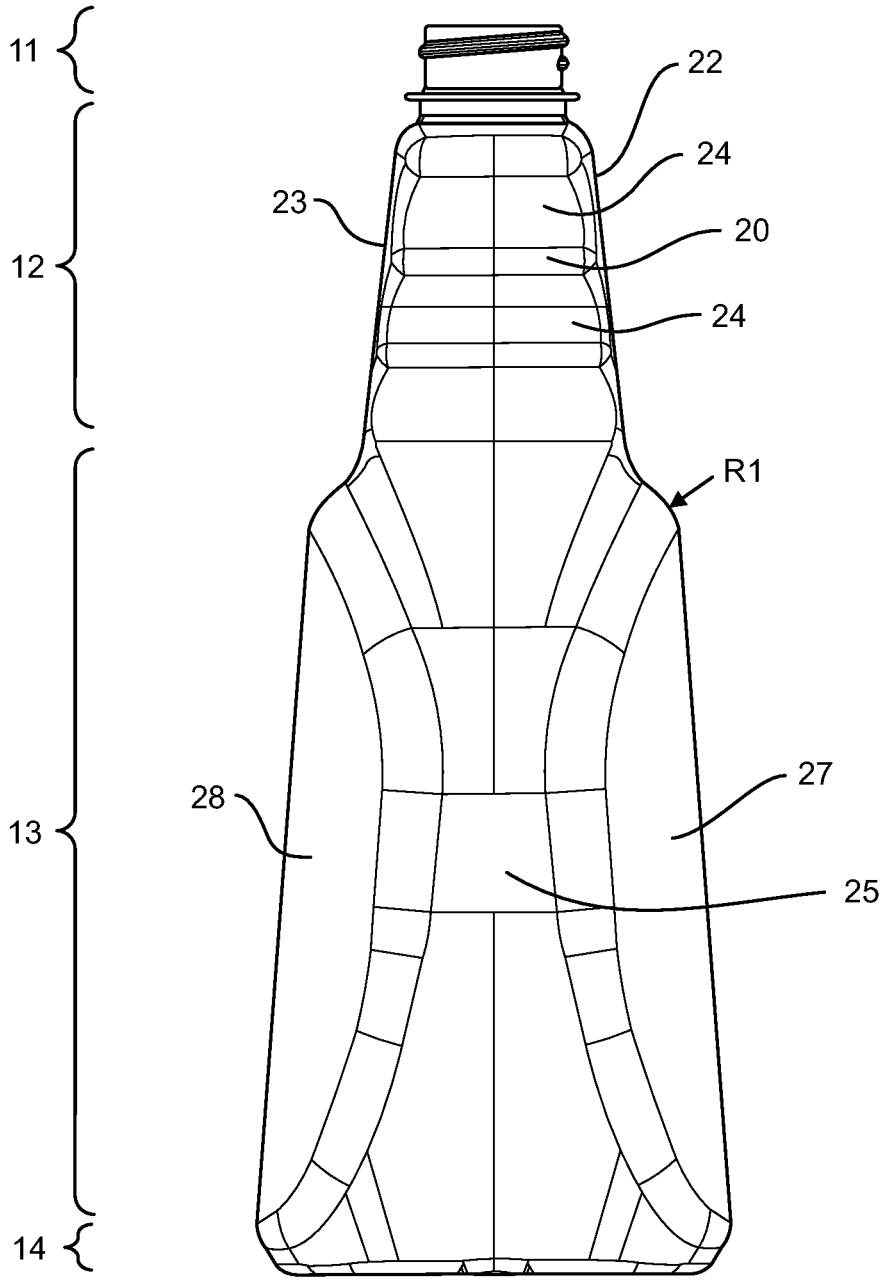
FIG. 2 PRIOR ART
FIG. 2 is a front view of the bottle shown in FIG. 1.

Turning to FIGS. 1-2, a prior art bottle 10 with a relatively rounded body profile is illustrated as including a mouth 11, a neck 12, a barrel 13, and a base 14. The neck 12 includes a front wall 20, a back wall 21, and two opposing sidewalls (22, 23) interconnecting the front and back walls (20, 21). The front wall 20 includes a plurality of horizontal grooves 24 contoured to accommodate gripping fingers of a user. The barrel 13 also includes a front wall 25, a back wall 26, and two opposing sidewalls (27, 28) interconnecting the front and back walls (25, 26). As illustrated in FIGS. 1-2, the neck 12 is connected to the barrel 13 through a relatively large transition radius R1. Moreover, the barrel sidewalls (27, 28) have generally rounded side profiles. Finally, the back wall 21 of the neck 12 merges into the back wall 26 of the barrel at a relatively narrow angle of about 14°. According to general knowledge in bottle design, those features would purportedly improve top loading strength of the bottle 10.

Figure 3:
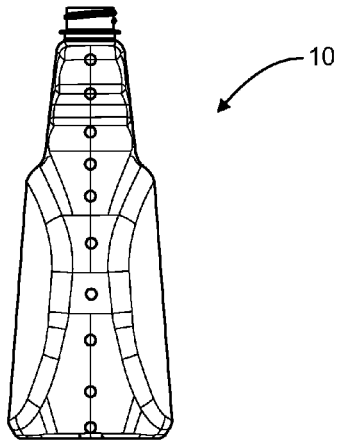
FIG. 3 PRIOR ART
FIG. 3 graphically illustrates the longitudinal and latitudinal wall thickness profile of one embodiment of the bottle shown in FIGS. 1-2.
Figure 3:
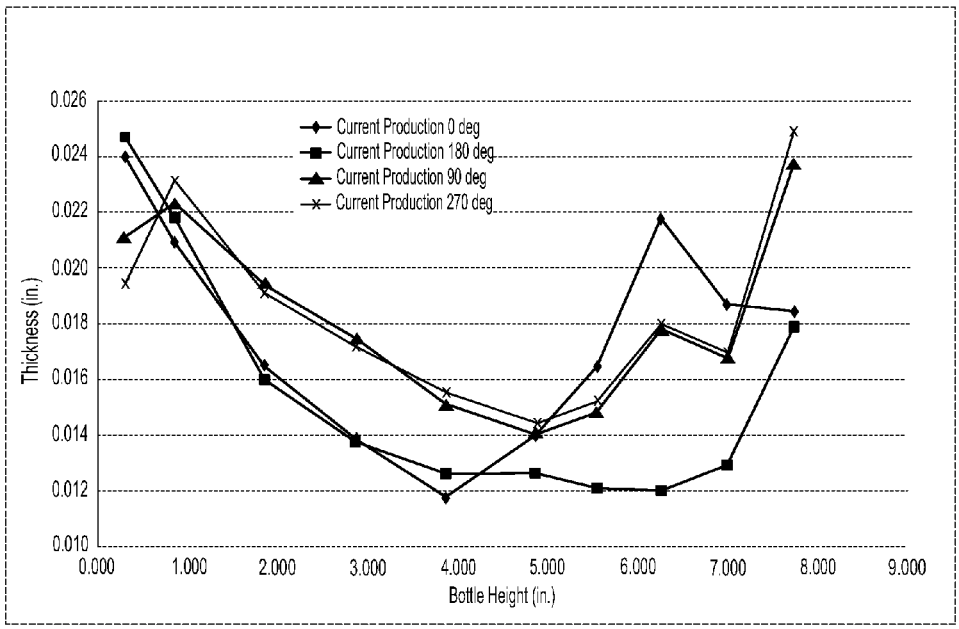
FIG. 3 PRIOR ART
Figure 5:
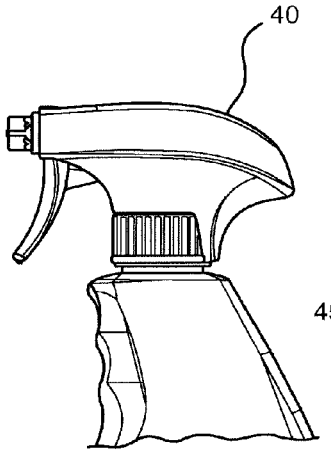
FIG. 5 is a side view of a trigger spray cap for the bottle shown in FIG. 4.

Another feature of the prior art bottle 10 is that the wall thickness of the neck 12 is non-uniform. FIG. 3 graphically illustrates the longitudinal and latitudinal thickness profiles of the bottle 10 (with a bottle height of about 9 inches), in which wall thickness along major axis (0°, 180°) and minor axis (90°, 270°) are measured at incremental heights indicated as black circle marks on the transparent bottle. The thickness measurements at different elevations of the bottle are also listed below in Table 1. As shown in FIG. 3 and Table 1, while longitudinal and latitudinal thickness remains substantially uniform in the barrel 13, the thickness profile of the neck 12 is far from uniform. In particular, the thickness of the front wall 20 (e.g. 0.0178 inch) is about the same as the thickness of the sidewalls (22, 23) (e.g. 0.0176) whereas the back wall 21 (e.g. 0.0136 inch) is substantially thinner than both the front wall 20 and the sidewalls (22, 23), such as by about 23%.

TABLE 1

Thickness Profile of Bottle in FIG. 3

| Component | Height (inch) | 0° (mm) | 90° (mm) | 180° (mm) | 270° (mm) |
|---|---|---|---|---|---|
| Neck | 7.727 | 0.018 | 0.024 | 0.018 | 0.025 |
| Neck | 6.980 | 0.019 | 0.017 | 0.013 | 0.017 |
| Neck | 6.250 | 0.022 | 0.018 | 0.012 | 0.018 |
| Neck | 5.550 | 0.016 | 0.015 | 0.012 | 0.015 |
| Neck | 4.860 | 0.014 | 0.014 | 0.013 | 0.014 |
| Barrel | 3.860 | 0.012 | 0.015 | 0.013 | 0.016 |
| Barrel | 2.860 | 0.014 | 0.017 | 0.014 | 0.017 |
| Barrel | 1.860 | 0.016 | 0.019 | 0.016 | 0.019 |
| Barrel | 0.860 | 0.021 | 0.022 | 0.022 | 0.023 |
| Base | 0.314 | 0.024 | 0.021 | 0.025 | 0.019 |

Barrel Thickess = 0.44 mm

Turning now to FIGS. 4-7, a bottle 30 according to a non-limiting embodiment of this disclosure is illustrated as including a mouth 31, a neck 32, a barrel 33, and a base 34. The mouth 31 is generally cylindrical and may include an upper section 35 terminating into a top opening 36 and a lower section 37 connected to the neck 32. The upper section 35 may include surface threads 38 and an annular abutment 39 for complementary reception and fitment of a threaded trigger spray cap 40.

The neck 32 may include a front wall 41, a back wall 42, and two opposing sidewalls (43, 44) interconnecting the front and back walls (41, 42). The front wall 41 may include a plurality of horizontal grooves 45 contoured to accommodate gripping fingers of a user. Unlike the neck 12 of the bottle 10 illustrated in FIGS. 1-2, in which the walls are interconnected through relatively gradual or rounded edges (i.e. with relatively large transition radii), at least some of the neck walls of the bottle 30 are interconnected through relatively abrupt or square edges (i.e. with relatively small transition radii).

Figure 4:
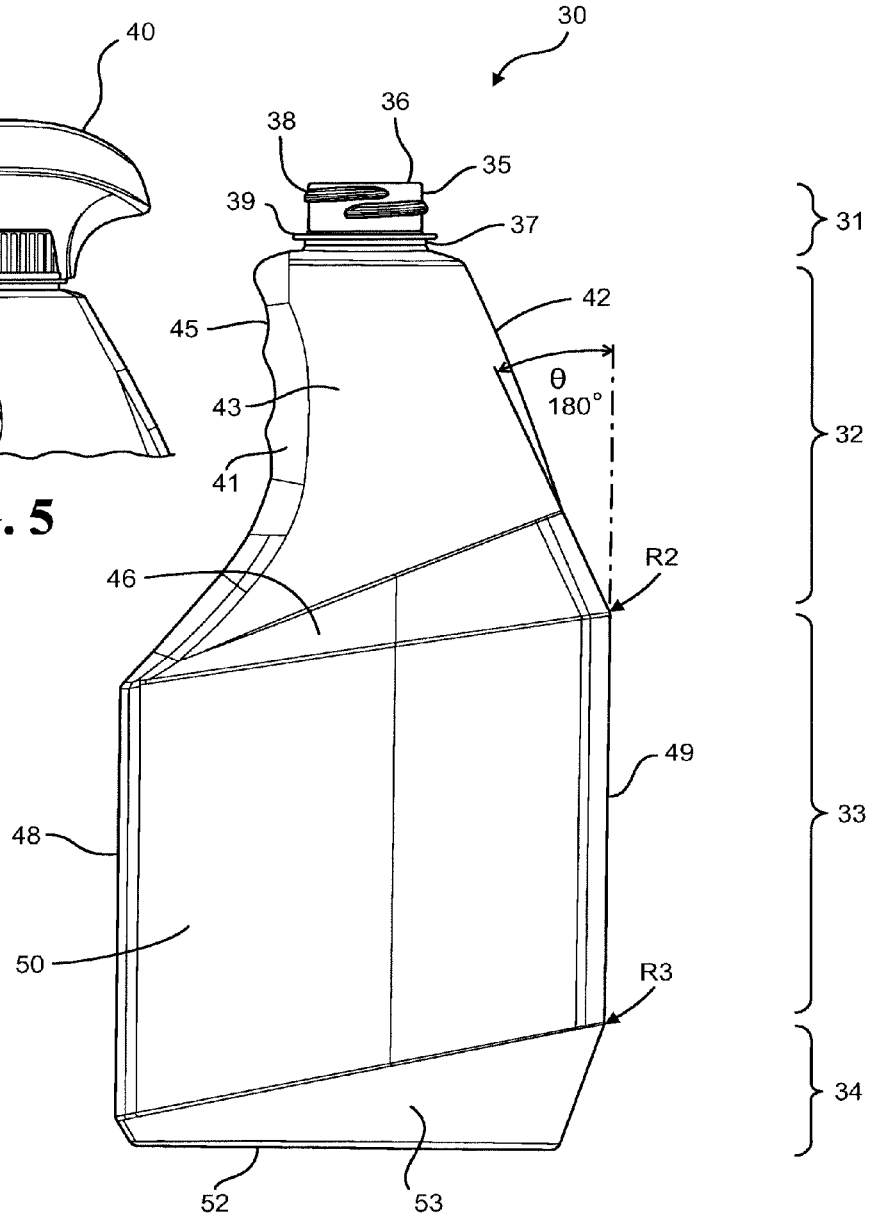
FIG. 4 is a side view of a bottle with a relatively square body profile according to this disclosure.
Figure 7:
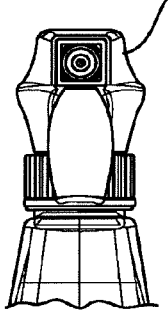
FIG. 7 is a front view of the trigger spray cap shown in FIG. 5.
Figure 6:
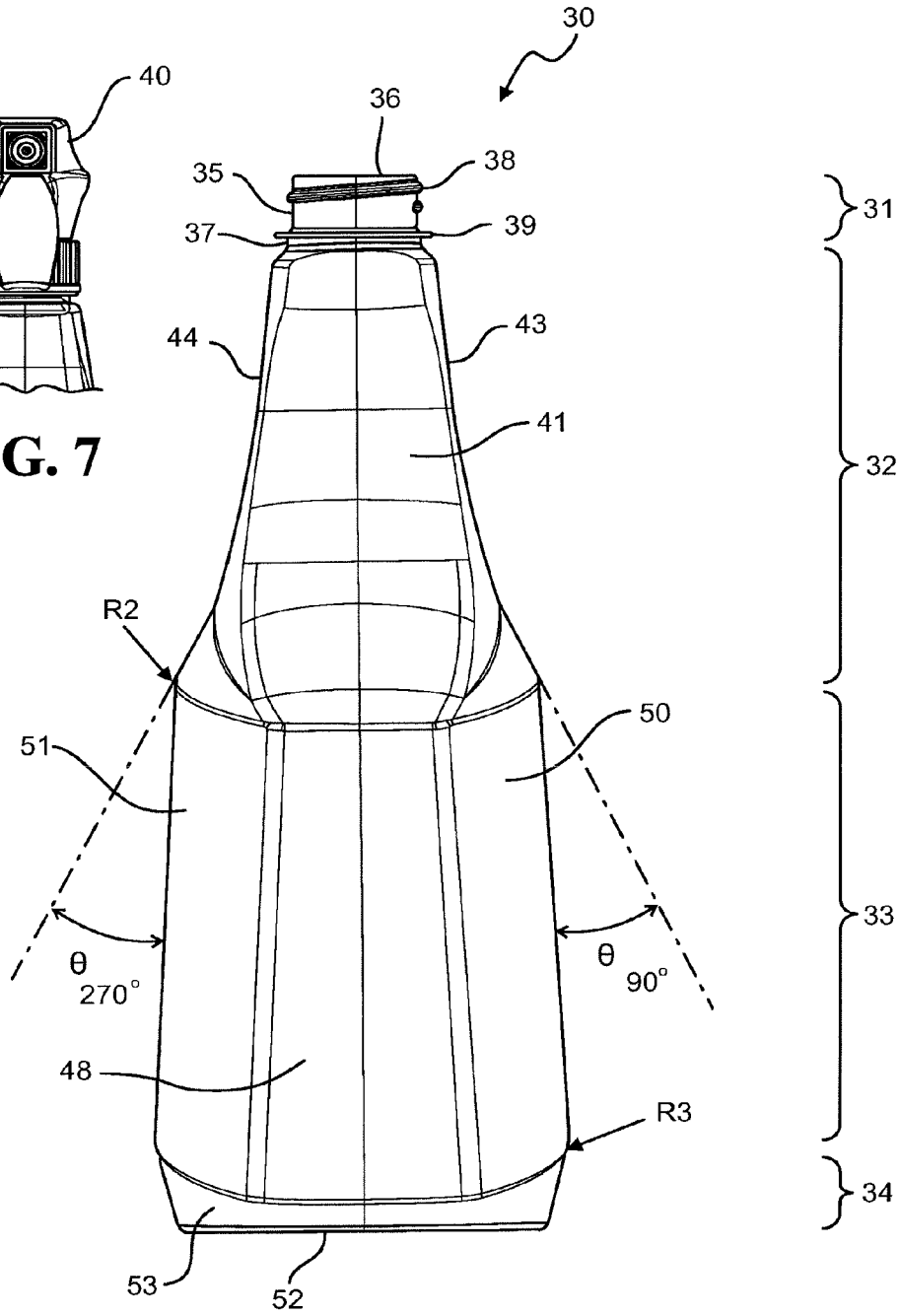
FIG. 6 is a front view of the bottle shown in FIG. 4.

As illustrated in FIGS. 4 and 6, the neck 32 may also include a shoulder 46 that is connected to the barrel 33 through a relatively small transition radius R2 (compared to the relatively large transition radius R1 in the bottle 10), thereby contributing to the overall square body profile of the bottle 30. In some embodiments, the shoulder 46 may have a smooth continuous surface. In other embodiments, the shoulder may include walls interconnected by more abrupt transitions that form edges. Moreover, the back merging angle $\theta_{180°}$ between the neck 32 and barrel 33 of the bottle 30 may be greater than that of the bottle 10. For example, the back merging angle $\theta_{180°}$ of the bottle 30 may be at least about 15° (e.g. about 17°) while that of the bottle 10 may be about 14°. The side merging angles $\theta_{90°}$ and $\theta_{270°}$ may also be at least about 15° (e.g. about 17°) in some embodiments.

Still referring to FIGS. 4 and 6, the barrel 33 may include a front wall 48, a back wall 49, and two opposing sidewalls (50, 51) interconnecting the front and back walls (48, 49). Unlike the barrel 13 of the bottle 10 illustrated in FIGS. 1-2, in which the walls are interconnected through relatively rounded edges (i.e. with relatively large transition radii), at least some of the barrel walls of the bottle 30 are interconnected through relatively square edges (i.e. with relatively small transition radii), thereby contributing to the overall square body profile of the bottle 30. Moreover, although the sidewalls (50, 51) of the bottle 30 are illustrated as slightly curved parallelogram in FIGS. 4 and 6, it is to be understood that other edged shapes, such as square, rectangular, trapezoid, trapezium, either curved or planar, may also be used in light of this disclosure.

Figure 8:
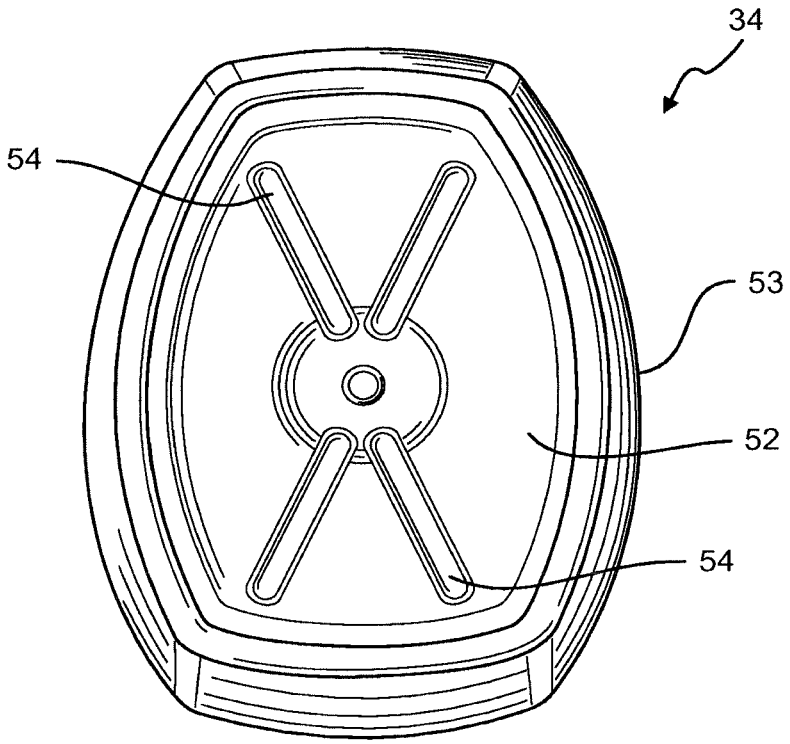
FIG. 8 is a bottom view of the bottle shown in FIGS. 4 and 6.

The base 34 includes a bottom wall 52 and a sidewall 53 upwardly extending from the bottom wall 52 and merging into the barrel 33 through a relatively small transition radius R3 to complete the overall square profile of the bottle 30. In some embodiments, the sidewall 53 may have a smooth continuous surface. In other embodiments the sidewall 53 may include sections interconnected by more abrupt transitions that form edges. As illustrated in FIG. 8, the bottom wall 52 maybe concaved and may include a plurality of radially extending ribs 54 to enhance the top loading strength of the bottle 30.

Figure 9:
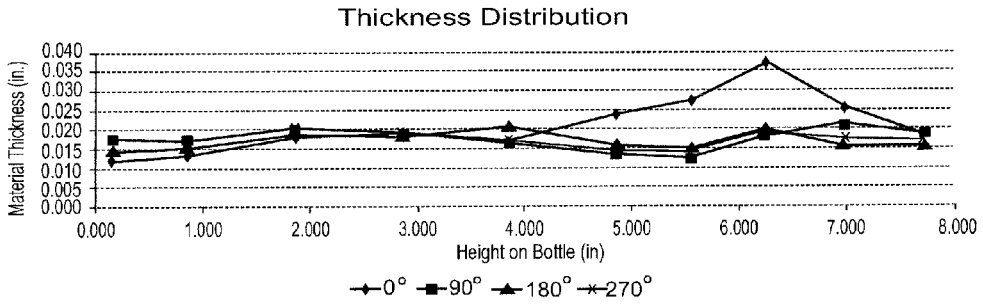
FIG. 9 graphically illustrates the longitudinal and latitudinal wall thickness profile of one embodiment of the bottle shown in FIGS. 4 and 6.

Another feature of the bottle 30 is that the wall thickness of the neck 32 is non-uniform. FIG. 9 graphically illustrates the longitudinal and latitudinal thickness profiles of the bottle 30 (with a bottle height of about 9 inches), in which wall thickness along major axis (0°, 180°) and minor axis (90°, 270°) are measured at incremental heights indicated as black line marks on the transparent bottle. The thickness measurements at different elevations of the bottle are also listed below in Table 2. As shown in FIG. 9 and Table 2, while longitudinal and latitudinal thickness remains substantially uniform in the barrel 33, the thickness profile of the neck 32 is far from uniform. In particular, the front wall 41 is about 1.5 times as thick as the sidewalls (43,44). As the thickness of the back wall 42 is essentially the same as the sidewalls (43,44), the front wall 41 is also about 1.5 times as thick as the back wall 42. Without wishing to be bound by any particular theory, it is contemplated that such redistribution of thickness and material in the neck area (as compared to the bottle 10) may improve the top loading strength of the bottle 30.

TABLE 2

Thickness Profile of Bottle in FIG. 9

| Component | Height (inch) | 0° (in.) | 90° (in.) | 180° (in.) | 270° (in.) |
|---|---|---|---|---|---|
| Neck | 7.727 | 0.018 | 0.019 | 0.016 | 0.017 |
| Neck | 6.980 | 0.026 | 0.021 | 0.016 | 0.018 |
| Neck | 6.250 | 0.037 | 0.019 | 0.020 | 0.018 |
| Neck | 5.550 | 0.027 | 0.012 | 0.015 | 0.013 |
| Neck | 4.860 | 0.024 | 0.014 | 0.016 | 0.015 |
| Barrel | 3.860 | 0.018 | 0.017 | 0.021 | 0.017 |
| Barrel | 2.860 | 0.019 | 0.019 | 0.020 | 0.019 |
| Barrel | 1.860 | 0.018 | 0.020 | 0.020 | 0.020 |
| Barrel | 0.860 | 0.014 | 0.017 | 0.016 | 0.016 |
| Base | 0.156 | 0.012 | 0.018 | 0.015 | 0.017 |

Barrel Thickness = 0.46 mm

In order to evaluate the top loading strength of a bottle disclosed herein, the bottle was subjected to increasing vertical load (lbf) while the vertical deformation of the bottle (inch) was recorded until the bottle crushes. Typically, a relatively linear relationship exists between the vertical load and vertical deformation until the bottle starts to crush, at which point the vertical load remains constant or may even decrease as the vertical deformation increases. Thus, the vertical load just before crush ("crushing load") and the corresponding vertical deformation ("crushing deformation") are two parameters that may be used to characterize the top loading strength of the bottle, with a higher crushing load or lower crushing deformation indicating better top loading strength. When evaluating and comparing bottles with different dimensions and shapes, however, the crushing load and/or crushing deformation may be insufficient in addressing the effect of bottle design on the top load strength, as bottles constructed with thicker walls and/or more plastic material are generally expected to have greater crushing load and lower crushing deformation than bottles with thinner walls and/or less plastic material. Thus, parameters reflecting crushing load based on certain bottle parameters may be more indicative of the effect of bottle design on the top load strength.

One bottle specific parameters is weight and volume specific top loading strength L(m,v), which is defined by Equation I, $$L(m,v)=(CL\times V)/M \quad \text{(I)}$$

wherein CL is the crushing load of the bottle (lbf), V is the interior volume of the bottle (L), and M is the weight of the bottle (g). According, the weight and volume specific top loading strength L(m,v) has a unit of (lbf×L)/g. As can be seen in Equation I, for two bottles having the same interior volume and achieving the same crushing load, the bottle with a higher weight (i.e. less efficient design) will have a lower L(m,v) than a bottle of a lower weight (i.e. more efficient design). Similarly, for two bottles having the same weight and achieving the same crushing load, the bottle with a lower interior volume (i.e. less efficient design) will have a lower L(m,v) than a bottle of a higher interior volume (i.e. more efficient design). Thus, higher weight and volume specific top loading strength factors generally indicate better and more efficient bottle designs.

Another bottle specific parameter is weight and barrel thickness specific top loading strength L(m,t), which is defined by Equation II, $$L(m,t)=CL/(M\times T) \quad \text{(II)}$$

wherein CL is the crushing load of the bottle (lbf), M is the weight of the bottle (g), and T is the barrel thickness of the bottle (mm). According, the weight and volume specific top loading strength L(m,t) has a unit of lbf/(g×mm). As can be seen in Equation II, for two bottles having the same weight and achieving the same crushing load, the bottle with a thicker barrel (i.e. less efficient design) will have a lower L(m,t) than a bottle of a thinner barrel (i.e. more efficient design). Similarly, for two bottles having the same barrel thickness and achieving the same crushing load, the bottle with a higher weight (i.e. less efficient design) will have a lower L(m,t) than a bottle of a lower weight (i.e. more efficient design). Thus, higher weight and barrel thickness specific top loading strength factors also generally indicate better and more efficient bottle designs.

1000 mL Bottles

The top load strength of the bottle 10 is evaluated with ten sample bottles. The results of the tests are listed below in Table 3 and illustrated in FIG. 10. The tested bottles have crushing loads of from 33.53 lbf to 53.72 lbf, with an average crushing load of 42.56 lbf and a standard deviation of 5.784. As the tested bottles have an average weight of 43 g, an average interior volume of 1 L, and an average barrel thickness of 0.44 mm (according to Table 1). Following Equations I and II, the bottle 10 is calculated to have an L(m,v) of 0.99 (lbf×L)/g and an L(m,t) of 2.25 lbf/(g×mm).

TABLE 3

| Top Loading Strength of Bottle in FIG. 3 | |
|---|---|
| | Crushing Load (lbf) |
| Average | 42.56 |
| Standard Deviation | 5.784 |
| Max | 53.72 |
| Min | 33.53 |

Figure 10:
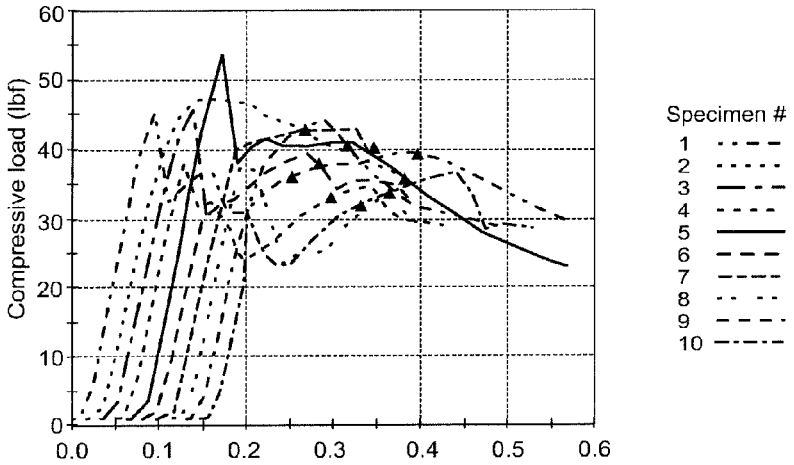
FIG. 10 graphically illustrates the top loading performance of the bottle shown in FIGS. 1-2.

As shown in FIG. 10, the top loading response of the bottle 10 is not linear and appears to have two stages. At first, the vertical load increases relatively rapidly with the vertical deformation, indicating a good top loading response. As the vertical load approaches a peak level, however, the vertical load drops substantially while the vertical deformation changes only slightly. The vertical load then levels as the vertical deformation continues to increase until the bottle finally crushes at the crushing load. As illustrated in FIG. 10, the crushing deformation for the bottle 10 ranges from about 0.25 inch to about 0.40 inch.

The top load strength of the bottle 30 in FIG. 9 is also evaluated with twelve sample bottles. The results of the tests are listed below in Table 4 and illustrated in FIG. 11. The tested bottles have crushing loads of from about 44.9 lbf to about 53.0 lbf, with an average crushing load of 47.6 lbf and a standard deviation of 2.3. As the tested bottles have an average weight of 39 g, an average interior volume of 1 L, and an average barrel thickness of 0.46 mm (according to Table 2). Following Equations I and II, the bottle 30 in FIG. 9 is calculated to have an L(m,v) of 1.22 (lbf×L)/g and an L(m,t) of 2.65 lbf/(g×mm).

TABLE 4

| Top Loading Strength of Bottle in FIG. 9 | |
|---|---|
| | Crushing Load (lbf) |
| Average | 47.6 |
| Standard Deviation | 2.3 |
| Max | 53.0 |
| Min | 44.9 |

Figure 11:
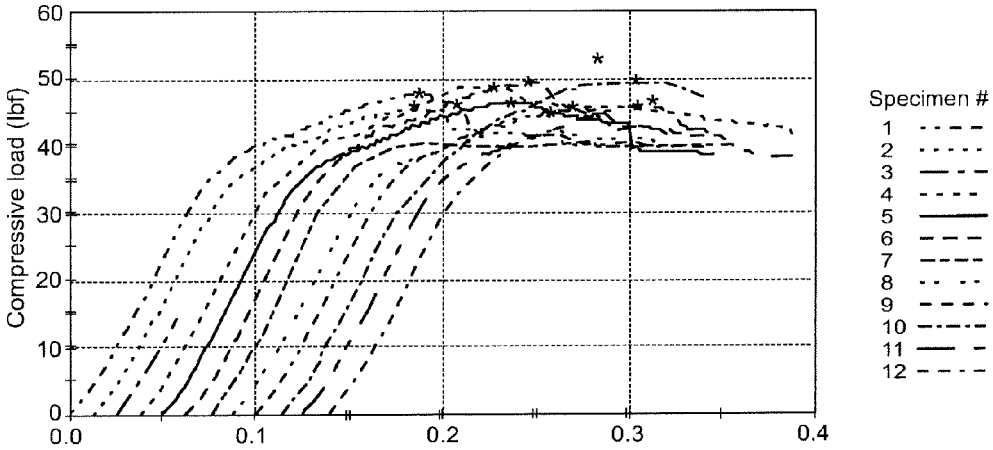
FIG. 11 graphically illustrates the top loading performance of the bottle shown in FIGS. 4 and 6.

Moreover, as shown in FIG. 11, the top loading response of the bottle 10 is also non-linear and appears to have two stages. Notably, the vertical load initially increases with the vertical deformation at a similar rate than the bottle 10 illustrated in FIG. 10. When the vertical load approaches a certain level, however, the curves start to level when the tested bottles sustain substantial vertical deformation while the vertical load remains substantially unchanged or changed only slightly until the bottle finally crushes at a crushing load. No sudden drop in vertical load is observed in the bottle 30 as compared to bottle 10 (FIG. 10), which may indicate a more effective top loading response in the bottle 30. As illustrated in FIG. 11, the crushing deformation for the bottle 30 ranges from about 0.17 inch to about 0.37 inch, which is significant shift compared to the 0.25-0.40 inch range achieved by the bottle 10, another indication that the bottle 30 have better top loading strength that the bottle 10.

Figure 12:
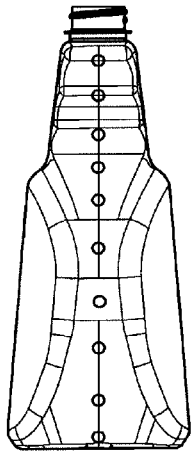
FIG. 12 is a photograph of another embodiment of the bottle shown in FIGS. 4 and 6.
Figure 13:
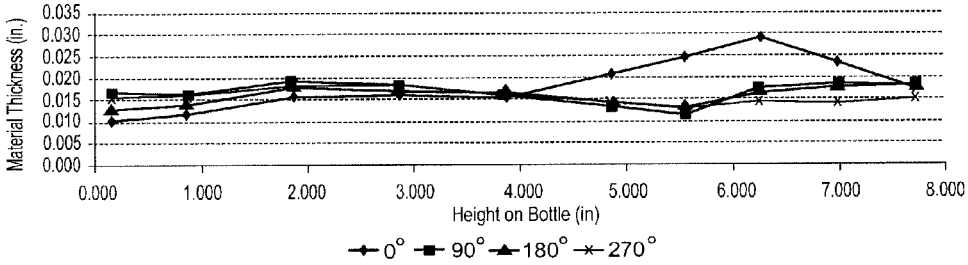
FIG. 13 graphically illustrates the longitudinal and latitudinal wall thickness profile of the bottle shown in FIG. 12.

The weight of the bottle 30 may be further reduced without sacrificing its interior volume or top loading strength. For example, FIGS. 12-13 illustrate another embodiment of the bottle 30 with the same interior volume (1 L) and a lesser weight of 36 g. The thickness measurements at different elevations of the bottle 30 in FIG. 13 are listed below in Table 5.

TABLE 5

| Thickness Profile of Bottle in FIG. 12 | | | | | |
|---|---|---|---|---|---|
| Component | Height (inch) | 0° (in.) | 90° (in.) | 180° (in.) | 270° (in.) |
| Neck | 7.727 | 0.017 | 0.018 | 0.015 | 0.015 |
| Neck | 6.980 | 0.023 | 0.018 | 0.014 | 0.014 |
| Neck | 6.250 | 0.029 | 0.017 | 0.017 | 0.014 |
| Neck | 5.550 | 0.024 | 0.012 | 0.013 | 0.012 |
| Neck | 4.860 | 0.021 | 0.014 | 0.013 | 0.014 |
| Barrel | 3.860 | 0.015 | 0.016 | 0.017 | 0.016 |
| Barrel | 2.860 | 0.016 | 0.018 | 0.017 | 0.017 |
| Barrel | 1.860 | 0.016 | 0.019 | 0.018 | 0.019 |
| Barrel | 0.860 | 0.012 | 0.016 | 0.014 | 0.016 |
| Base | 0.156 | 0.010 | 0.017 | 0.013 | 0.016 |

Barrel Thickness = 0.416 mm

Figure 14:
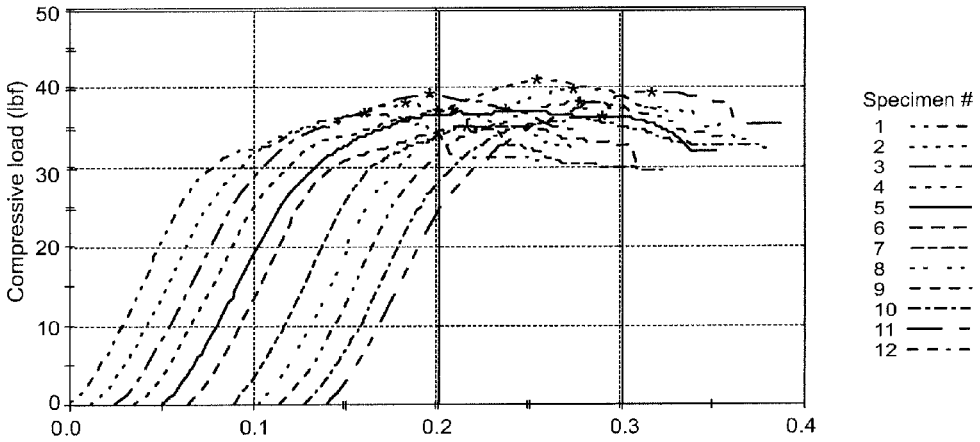
FIG. 14 graphically illustrates the top loading performance of the bottle shown in FIG. 12.

The top load strength of the bottle 30 in FIGS. 12 and 13 is evaluated with twelve sample bottles. The results of the tests are listed below in Table 6 and illustrated in FIG. 14. The tested bottles have crushing loads of from about 35.1 lbf to about 41.2 lbf, with an average crushing load of 38.0 lbf and a standard deviation of 1.7. As the tested bottles have an average weight of 36 g, an average interior volume of 1 L, and an average barrel thickness of 0.416 mm (according to Table 5). Following Equations I and II, the bottle 30 in FIG. 12 is calculated to have an L(m,v) of 1.06 (lbf×L)/g and an L(m,t) of 2.54 lbf/(g×mm).

TABLE 6

| Top Loading Strength of Bottle in FIG. 12 | |
|---|---|
| | Crushing Load (lbf) |
| Average | 38.0 |
| Standard Deviation | 1.7 |
| Max | 41.2 |
| Min | 35.1 |

800 mL Bottles

It is to be understood that the bottle design in accordance with the present application is not limited to bottles having an interior volume of 1 L discussed above. In the following non-limiting example, a prior art bottle 60 (FIG. 15) with a lesser interior volume of 0.8 L is compared with two bottles 70 (FIGS. 17 and 19) made in accordance with this disclosure having the same interior volume (0.8 L). The bottle 60 has substantially the same shape as the bottle 10 but with a lesser weight of 41.5 g (as compared to 43 g) and includes all of the structural features of the bottle 10.

The thickness measurements at different elevations of the bottle 60 are listed below in Table 7.

TABLE 7

| Thickness Profile of Bottle 60 | | | | | |
|---|---|---|---|---|---|
| Component | Height (inch) | 0° (mm) | 90° (mm) | 180° (mm) | 270° (mm) |
| Neck | 7.727 | 0.018 | 0.025 | 0.019 | 0.023 |
| Neck | 6.980 | 0.018 | 0.018 | 0.014 | 0.016 |
| Neck | 6.250 | 0.024 | 0.022 | 0.014 | 0.019 |
| Neck | 5.550 | 0.016 | 0.015 | 0.013 | 0.014 |
| Neck | 4.860 | 0.014 | 0.016 | 0.014 | 0.015 |
| Barrel | 3.860 | 0.013 | 0.017 | 0.013 | 0.017 |
| Barrel | 2.860 | 0.015 | 0.019 | 0.016 | 0.019 |
| Barrel | 1.860 | 0.019 | 0.022 | 0.019 | 0.022 |
| Barrel | 0.860 | 0.020 | 0.024 | 0.022 | 0.024 |
| Base | 0.156 | 0.011 | 0.014 | 0.012 | 0.014 |

Barrel Thickness = 0.48 mm

The top load strength of the bottle 60 is evaluated with twelve sample bottles. The results of the tests are listed below in Table 8 and illustrated in FIG. 16. The tested bottles have crushing loads of from about 29.2 lbf to about 47.5 lbf, with an average crushing load of 41.6 lbf and a standard deviation of 5.4. As the tested bottles have an average weight of 41.5 g, an average interior volume of 0.8 L, and an average barrel thickness of 0.48 mm (according to Table 7). Following Equations I and II, the bottle 60 in FIG. 15 is calculated to have an L(m,v) of 0.80 (lbf×L)/g and an L(m,t) of 2.09 lbf/(g×mm).

TABLE 8

Figure 15:
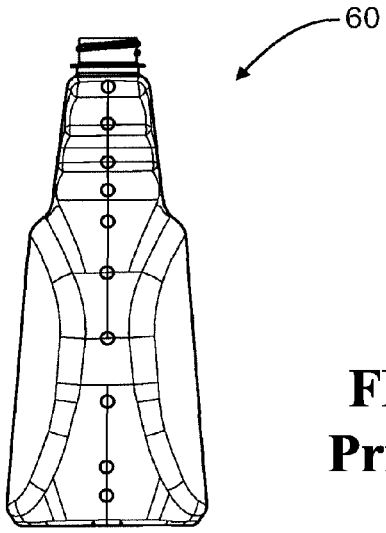
FIG. 15 Prior Art
FIG. 15 is a photograph of another known bottle (prior art) with a relatively rounded body profile.
Figure 16:
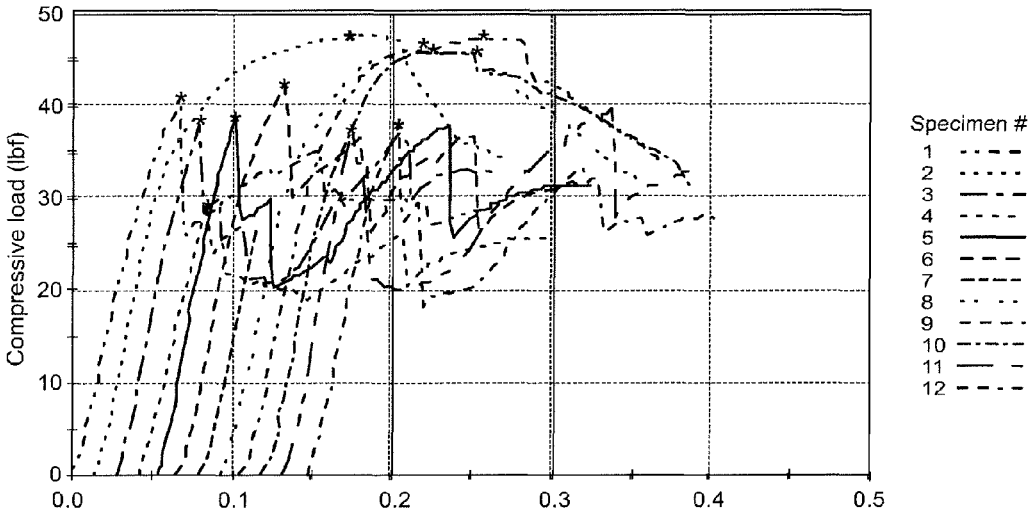
FIG. 16 Prior Art
FIG. 16 graphically illustrates the top loading performance of the bottle shown in FIG. 15.

Top Loading Strength of Bottle in FIG. 15

| | Crushing Load (lbf) |
|---|---|
| Average | 41.6 |
| Standard Deviation | 5.4 |
| Max | 47.5 |
| Min | 29.2 |

Figure 17:
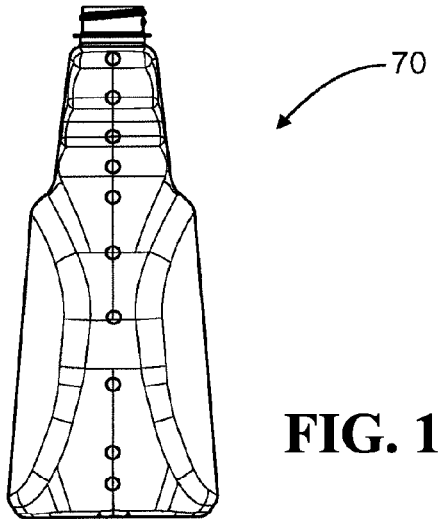
FIG. 17 is a photograph of another bottle with a relatively square body profile according to this disclosure.

Referring now to FIG. 17, the bottle 70 according to the present application has substantially the same shape as the bottle 30 and includes most, if not all, of the structural features of the bottle 30. Those features include redistribution of the thickness profile of the bottle (e.g. the neck), increasing the neck-barrel merging angle despite the general knowledge in the art to the contrary, and incorporating structural components such as the shoulder, base, and bottom ribs. The weight of the bottle 70 in FIG. 17 is 36 g.

The thickness measurements at different elevations of the bottle 70 are listed below in Table 9.

TABLE 9

Thickness Profile of Bottle in FIG. 17

| Component | Height (inch) | 0° (mm) | 90° (mm) | 180° (mm) | 270° (mm) |
|---|---|---|---|---|---|
| Neck | 7.727 | 0.018 | 0.016 | 0.014 | 0.017 |
| Neck | 6.980 | 0.023 | 0.019 | 0.013 | 0.021 |
| Neck | 6.250 | 0.030 | 0.019 | 0.014 | 0.025 |
| Neck | 5.550 | 0.027 | 0.014 | 0.014 | 0.018 |
| Neck | 4.860 | 0.022 | 0.013 | 0.013 | 0.013 |
| Barrel | 3.860 | 0.014 | 0.013 | 0.015 | 0.014 |
| Barrel | 2.860 | 0.014 | 0.015 | 0.015 | 0.015 |
| Barrel | 1.860 | 0.016 | 0.018 | 0.016 | 0.019 |
| Barrel | 0.860 | 0.013 | 0.019 | 0.015 | 0.020 |
| Base | 0.156 | 0.010 | 0.020 | 0.013 | 0.020 |

Barrel Thickness = 0.40 mm

Figure 18:
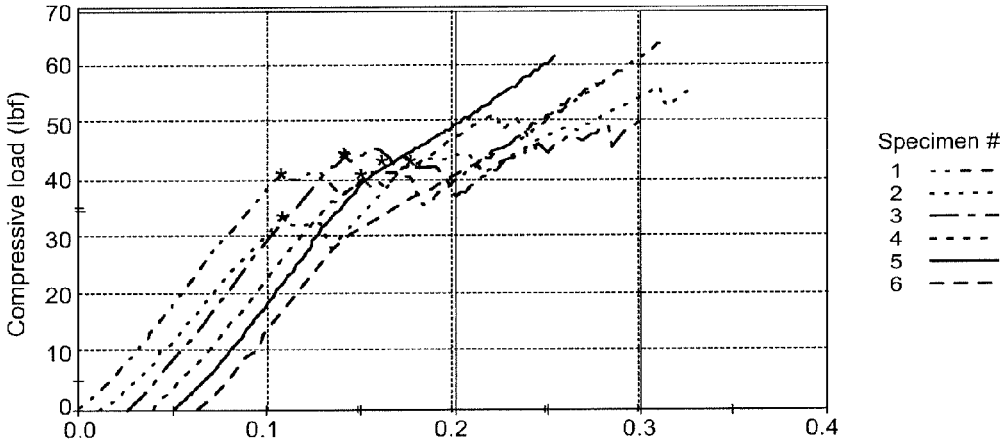
FIG. 18 graphically illustrates the top loading performance of the bottle shown in FIG. 17.

The top load strength of the bottle 70 in FIG. 17 is evaluated with six sample bottles. The results of the tests are listed below in Table 10 and illustrated in FIG. 18. The tested bottles have crushing loads of from about 39.0 lbf to about 47.2 lbf, with an average crushing load of 43.6 lbf and a standard deviation of 2.4. As the tested bottles have an average weight of 36 g, an average interior volume of 0.8 L, and an average barrel thickness of 0.40 mm (according to Table 9). Following Equations I and II, the bottle 70 in FIG. 17 is calculated to have an L(m,v) of 0.97 (lbf×L)/g and an L(m,t) of 3.03 lbf/(g×mm).

TABLE 10

Top Loading Strength of Bottle in FIG. 17

| | Crushing Load (lbf) |
|---|---|
| Average | 43.6 |
| Standard Deviation | 2.4 |
| Max | 47.2 |
| Min | 39.0 |

Figure 19:
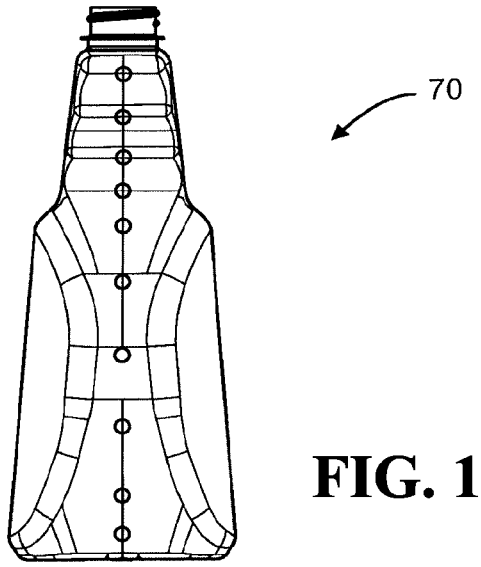
FIG. 19 is a photograph of another bottle with a relatively square body profile according to this disclosure.

Again, the weight of the bottle 70 may be further reduced without sacrificing its interior volume or top loading strength. For example, FIG. 19 illustrates another embodiment of the bottle 70 with the same interior volume (0.8 L) and a lesser weight of 34.5 g. The thickness measurements at different elevations of the bottle 70 in FIG. 19 are listed below in Table 11.

TABLE 11

Thickness Profile of Bottle in FIG. 19

| Component | Height (inch) | 0° (in.) | 90° (in.) | 180° (in.) | 270° (in.) |
|---|---|---|---|---|---|
| Neck | 7.727 | 0.018 | 0.016 | 0.014 | 0.018 |
| Neck | 6.980 | 0.025 | 0.023 | 0.013 | 0.026 |
| Neck | 6.250 | 0.036 | 0.023 | 0.018 | 0.028 |
| Neck | 5.550 | 0.027 | 0.014 | 0.015 | 0.020 |
| Neck | 4.860 | 0.024 | 0.013 | 0.015 | 0.013 |
| Barrel | 3.860 | 0.013 | 0.012 | 0.016 | 0.013 |
| Barrel | 2.860 | 0.012 | 0.013 | 0.014 | 0.014 |
| Barrel | 1.860 | 0.013 | 0.015 | 0.014 | 0.016 |
| Barrel | 0.860 | 0.011 | 0.017 | 0.013 | 0.017 |
| Base | 0.156 | 0.004 | 0.010 | 0.007 | 0.010 |

Barrel Thickness = 0.354 mm

Figure 20:
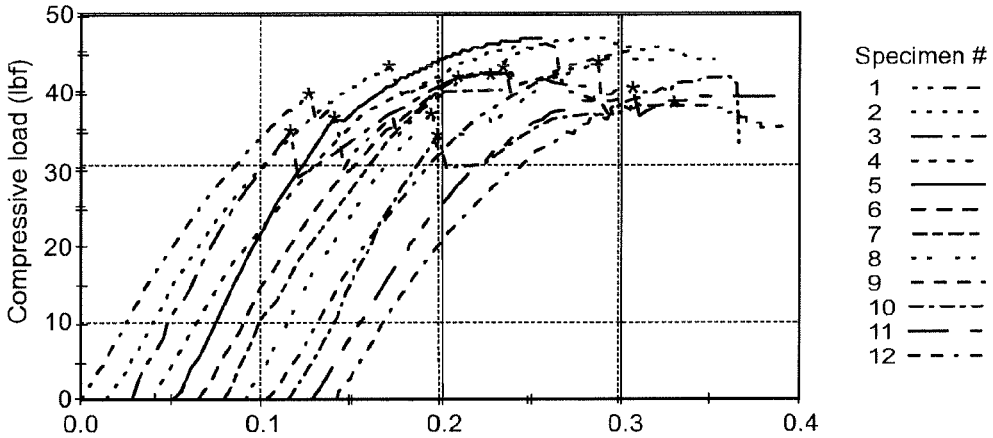
FIG. 20 graphically illustrates the top loading performance of the bottle shown in FIG. 19.

The top load strength of the bottle 70 in FIG. 19 is evaluated with twelve sample bottles. The results of the tests are listed below in Table 12 and illustrated in FIG. 20. The tested bottles have crushing loads of from about 38.3 lbf to about 47.0 lbf, with an average crushing load of 43.4 lbf and a standard deviation of 2.8. As the tested bottles have an average weight of 34.5 g, an average interior volume of 0.8 L, and an average barrel thickness of 0.354 mm (according to Table 11). Following Equations I and II, the bottle 70 in FIG. 19 is calculated to have an L(m,v) of 1.01 (lbf×L)/g and an L(m,t) of 3.55 lbf/(g×mm)

TABLE 12

Top Loading Strength of Bottle in FIG. 19

| | Crushing Load (lbf) |
|---|---|
| Average | 43.4 |
| Standard Deviation | 2.8 |
| Max | 47.0 |
| Min | 38.3 |

In summary, the bottles having one, some, or all of the structural features according to the present application each has a weight and barrel thickness specific top loading strength of at least 2.30 lbf/(g×mm), whereas the two prior art bottles have weight and barrel thickness specific top loading strengths of 2.25 and 2.09 lbf/(g×mm) respectively. Moreover, with one exception, the bottles according to the present application has a weight and volume specific top loading strength of at least 1.00 (lbf×L)/g. In comparison, the two prior art bottles have weight and volume specific top loading strengths of at least 0.99 and 0.80 (lbf×L)/g, respectively.

Without wishing to be bound by any particular theory, such surprising and unexpected improved top loading strength for a bottle with relatively square body profile (as compared to the prior art bottles) may be a result of one, some or all of several design features, an insight heretofore unknown. Such design features may include, but are not limited to, redistribution of the thickness profile of the bottle (e.g. the neck), increasing the neck-barrel merging angle despite the general knowledge in the art to the contrary, and incorporating structural components such as the shoulder, base, and bottom ribs. Moreover, the disclosed bottles unexpectedly achieve similar or even improved top loading resistance compared to existing bottles, and do so with less commodity material (i.e. a lower bottle weight) and with no sacrifice of their volumetric capacities.

While only certain exemplary embodiments have been set forth, alternative embodiments and various modifications will be apparent from the above descriptions to those skilled in the art. These and other alternatives are considered equivalents and within the spirit and scope of this disclosure.

What is claimed is:

1. A bottle, comprising:

a neck terminating in a mouth, wherein the neck comprises two opposing sidewalls interconnecting opposing front and back walls; and a barrel connected to a base, wherein the bottle has a weight and barrel thickness specific top loading strength of at least 2.30 lbf/(gram·millimeter).

2. The bottle of claim 1, wherein the thickness of the neck front wall is about 1.5 times the thickness of the neck back wall.

3. The bottle of claim 2, wherein the thickness of the neck front wall is about 1.5 times the thickness of the neck sidewalls.

4. The bottle of claim 1, wherein the barrel comprises two opposing sidewalls interconnecting opposing front and back walls.

5. The bottle of claim 4, wherein the neck merges into the barrel back wall at an angle of no less than about 15°.

6. The bottle of claim 5, wherein the neck merges into the barrel sidewalls at an angle of no less than 15°.

7. The bottle of claim 1, wherein the base comprises a concave bottom wall, front and back walls upwardly extending from the bottom wall, and opposing sidewalls upwardly extending from the bottom wall and interconnecting the front and back walls.

8. The bottle of claim 7, wherein the barrel is wider than the bottom wall of the base.

9. The bottle of claim 7, wherein the bottom wall comprises radially extending reinforcement ribs.

10. A bottle, comprising:

a neck terminating in a mouth, the neck having a neck front wall thickness that is about 1.5 times greater than a remaining neck wall thickness at an equivalent bottle height; and a barrel connected to a base, wherein the bottle has a weight and volume specific top loading strength of at least 1.00 (lbf×Liter)/gram.

11. The bottle of claim 10, wherein the neck comprises two opposing sidewalls interconnecting opposing front and back walls.

12. The bottle of claim 11, wherein the thickness of the neck front wall is about 1.5 times the thickness of the barrel.

13. The bottle of claim 12, wherein the thickness of the neck front wall is about 1.5 times the thickness of the neck sidewalls.

14. The bottle of claim 10, wherein the neck merges into the barrel at an angle of no less than about 15°.

15. The bottle of claim 10, wherein the barrel comprises two opposing sidewalls interconnecting opposing front and back walls.

16. The bottle of claim 10, wherein the base comprises a concave bottom wall, front and back walls upwardly extending from the bottom wall, and opposing sidewalls upwardly extending from the bottom wall and interconnecting the front and back walls.

17. A plastic bottle, comprising:

a neck terminating in a mouth, wherein the neck comprises two opposing sidewalls interconnecting opposing front and back walls; and a barrel connected to a base, wherein the bottle has a weight and volume specific top loading strength of at least 1.00 (lbf×Liter)/gram, and a weight and barrel thickness specific top loading strength of at least 2.30 lbf/(gram·millimeter).

18. The bottle of claim 17, wherein the thickness of the neck front wall is about 1.5 times the thickness of the neck sidewalls.

19. The bottle of claim 17, wherein the neck merges into the barrel at an angle of no less than about 15°.

* * * * *